US005590972A

United States Patent [19]

Shobin

[11] Patent Number: 5,590,972

[45] Date of Patent: Jan. 7, 1997

[54] REINFORCEMENT STRIP AND KIT FOR USE IN ATTACHING A PAGE TO A WIRE BINDING OF A WIRE BOUND NOTEBOOK

[76] Inventor: Sharyn B. Shobin, 20 Thatch Pond Rd., Smithtown, N.Y. 11787

[21] Appl. No.: 555,871

[22] Filed: Nov. 13, 1995

[51] Int. Cl.[6] ..... B42F 13/00

[52] U.S. Cl. ..... 402/79; 402/500; 281/21.1; 281/38

[58] Field of Search ..... 402/79, 80 R, 402/80 L, 80 P, 500, 501, 19; 281/15.1, 21.1, 38

[56] References Cited

U.S. PATENT DOCUMENTS

| | | | |
|---|---|---|---|
| 2,848,163 | 8/1958 | Van Horne Serrell | 402/501 X |
| 4,193,704 | 3/1980 | Miller et al. | 402/19 |
| 4,430,015 | 2/1984 | Nerlinger | 402/79 |
| 4,820,075 | 4/1989 | Osono | 402/79 |
| 5,364,200 | 11/1994 | Russo et al. | 402/79 |

*Primary Examiner*—Willmon Fridie, Jr.

*Attorney, Agent, or Firm*—Galgano & Burke

[57] ABSTRACT

A reinforcement strip for attaching a torn page or additional page to a wire binding in a wire bound notebook. The reinforcement strip includes a reinforcement layer and an adhesive layer for attaching the reinforcement layer to the page. The reinforcement layer includes a plurality of apertures in a linear row adjacent an edge of the reinforcement layer and a plurality of slits. Each slit extends from the edge of the reinforcement layer to one of said apertures to form a passage for allowing a turn of a wire binding of a wire bound notebook to pass through. Each of the slits are generally angled to one side of a line normal to the linear row of apertures so that when the reinforcement strip is applied to a page the reinforcement strip effectively provides a continuous layer of reinforcing material between the holes and the edge of the page where tears typically occur. Also, disclosed is a kit for use in repairing or attaching a page in a wire bound notebook. Generally, the kit which includes two reinforcement strips in which each reinforcement strip includes a reinforcement layer, an adhesive layer, and an outer covering release sheet. Preferably, the two reinforcement strips each have slits which are angled in opposite directions compared to the other reinforcement strip.

16 Claims, 2 Drawing Sheets

FIG. 1
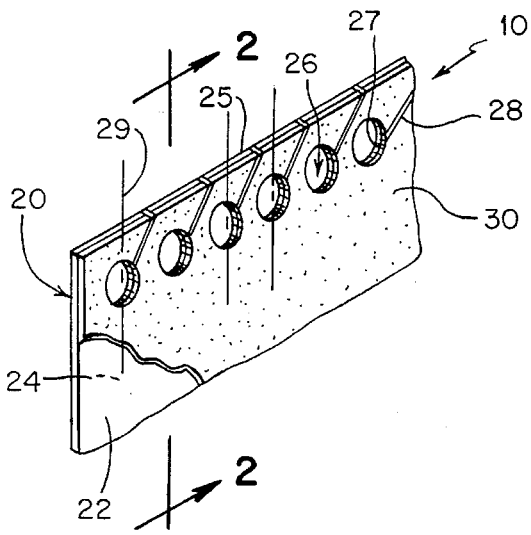
FIG. 2
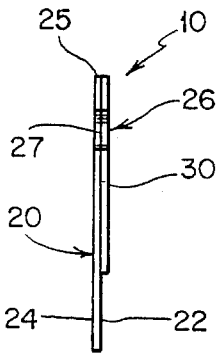
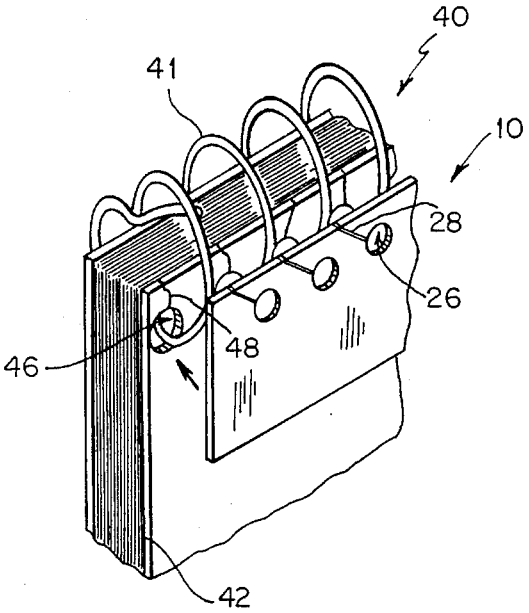
FIG. 3
FIG. 4
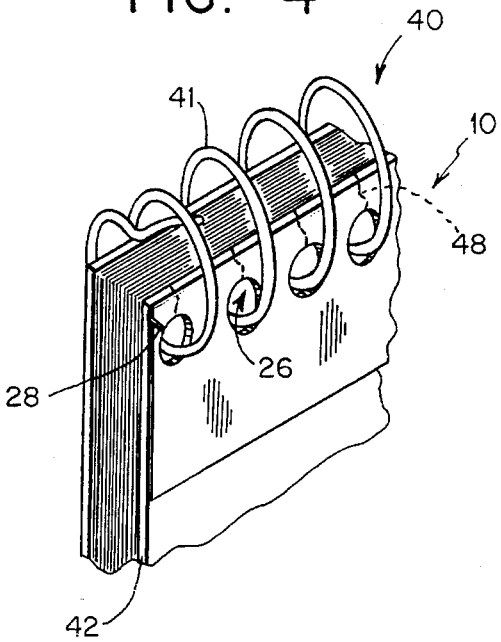

REINFORCEMENT STRIP AND KIT FOR USE IN ATTACHING A PAGE TO A WIRE BINDING OF A WIRE BOUND NOTEBOOK

BACKGROUND OF THE INVENTION

The present invention relates generally to a reinforcement strip. More particularly, the invention relates to a reinforcement strip and kit for use in repairing or attaching a page to a wire binding of a wire bound notebook.

Wire bound notebooks, and particularly spiral wire bound notebooks, are widely used by students, office workers and others for conveniently maintaining class notes, business records and other entries. In a wire bound notebook, a wire or a plastic strip is wound through perforated holes along an edge of the pages, typically front and back covers and paper sheets, in order to bind them together. Once bound, the pages cannot be removed from the wire binding without tearing each page, from each of the perforated holes to the edge of the page.

A main benefit of a wire bound notebook is that it retains the pages to the wire binding of the notebook in the event the notebook is accidentally dropped. A disadvantage with a wire bound notebook is the inability of reattaching a page to the wire binding should a page be torn from the notebook. Another disadvantage of a wire bound notebook is the inability of attaching to the wire binding a new or additional page in a desired location between the pages in a wire bound notebook.

Several devices have been proposed for reinforcing or repairing pages in notebooks. Many of these devices are applicable only to loose-leaf binders which operatively hold the pages in a way that allows for their removal without tearing the page. Specifically, a loose-leaf binder includes spring biased ring portions which in an open position are insertable in the perforated holes of a page and which in a closed position retains the pages together.

For example, U.S. Pat. No. 2,375,582 granted to Pitt discloses a grommet having a hole, and alternatively a strip having a plurality of holes, for reinforcing loose-leaf pages. The grommet and strip are attached to a page with the hole or holes in registration with the perforated holes of the page. Another example, U.S. Pat. No. 2,601,125 granted to O'Connor discloses a foldable reinforcement clip that attaches to the edge of a page. The reinforcement clip has holes which are folded about the edge of the paper in registration with the perforated holes of the page. Another example, U.S. Pat. No. 2,601,853 granted to Hirszson discloses a method of reinforcing perforated pages with a circular tab of reinforcing material having an offset hole that provides a greater amount of material to that portion of the page between the holes and the edge of a page where the page is most likely tear. Still another example, U.S. Pat. No. 4,431,325 granted to Colby discloses a reinforcement for corner mounting holes. The reinforcement comprises a corner shaped pocket member made of paper or other similar material. The pocket includes a front wall and a back wall each of which includes a hole located to be in registration with the corner mounting hole in a page when the corner shaped pocket is mounted onto the corner of the page. Still yet another example, U.S. Pat. No. 822,427 granted to Bushong discloses a leaf or page for loose-leaf binders. The page contains perforated holes along the edge of the page and the page has a slit or opening from the edge of the page to each of the holes.

The above devices, although appropriate for repair of a page in a loose-leaf binder, are not suitable for use in repair or insertion of a page in a wire bound notebook. All of the above disclosed devices, except Bushong, include reinforcement means that contain a hole or holes having a continuous surrounding edge which require a binder that is operable to allow insertion of a page without tearing the page from each of the perforated holes to the edge of the page. A wire bound notebook, by its very nature, is not operable to allow removal of a page without tearing it.

A device, applicable for inserting a page in a wire bound notebooks is disclosed in U.S. Pat. No. 4,430,015 granted to Nerlinger. Nerlinger discloses a fastening means for attaching documents and other items to a wire binder of a notebook. The fastening means include a plurality of tabs positioned adjacently such that they form a notch that opens to provide access to an aperture in which the wire binder is retained upon insertion of the fastening means into a notebook. Nerlinger, as well as Bushong, includes a slit or opening in the direction of the shortest distance from the edge of the perforated hole and the edge of the page. This requires the fastening means to be made out of a stronger material than that of the page, or that the fastening means be of an increased thickness, or a combination of stronger material and increased thickness. In Nerlinger, although the notched or V-shaped groove may enable one to more easily insert a wire binding into the fastening means, the adjacent tabs forms a smaller gap compared to the diameter of the wire binding and provides only a relatively small amount of available material for retaining the fastener means to the wire binding. Increasing the thickness of the fastening means, to increase it ability to retain the wire binding, limits the number of pages which can be effectively reattached or added to a wire binding of a wire bound notebook.

For completeness, U.S. Pat. No. 4,718,962 granted to Goodwin and U.S. Pat. No. 4,954,378 granted to Goodman disclose a shower curtain repair for repairing tears in plasticized sheet material.

SUMMARY OF THE INVENTION

Accordingly, it is an object of the present invention to provide a reinforcement strip for use in reattaching a page torn from a wire binding of a wire bound notebook.

It is also an object of the present invention to provide such a reinforcement strip for use in attaching an additional page to a wire binding of a wire bound notebook.

It is another object of the present invention to provide such a reinforcement strip for use in attaching a torn page from or attaching an additional page to a wire binding of a wire bound notebook in which the reinforcement strip effectively provides an unbroken layer of reinforcement material across the direction where a tear is typically to occur, i.e., along the shortest distance between the perforated hole and the edge of the page.

It is still another object of the present invention to provide such a reinforcement strip that is simple in construction and which may be manufactured relatively simply and inexpensively.

It is yet another object of the present invention to a kit having two reinforcement strips for use in attaching a page to a wire binding of a wire bound notebook.

Certain of the foregoing and related objects are readily obtained in a reinforcement strip for use in attaching a page to a wire binding of a wire bound notebook. The reinforcement strip includes a reinforcement layer having a first surface, a second surface, and a plurality of apertures extending through the first surface to the second surface. The plurality of apertures are positioned in generally a linear row adjacent a first edge of the reinforcement layer. The reinforcement layer further has a plurality of slits extending through the first surface to the second surface with each of the slits extending from the first edge of the reinforcement layer to a second edge defining the aperture to form a passage for allowing a turn of a wire binding of a wire bound notebook to pass from the first edge of the reinforcement layer to the aperture. Each of the slits being generally angled to one side of lines located adjacent each of the apertures on the first surface of the reinforcement layer and perpendicular to the linear row of apertures. The reinforcement strip further includes means for attaching said first surface of said reinforcement layer to a page.

Preferably, the reinforcement layer is generally rectangularly-shaped, the plurality of apertures are generally circularly-shaped and the slits are sized to a predetermined width that is slightly larger than a diameter of a wire binding of a wire bound notebook. Desirably, the reinforcement strip is fabricated from paper or plastic. Advantageously, attaching means includes a layer of moisture activated adhesive. Most advantageously, the attaching means includes an adhesive layer in covering relationship to the first surface of the reinforcement layer and an outer covering release sheet disposed in covering relationship on the adhesive layer.

Certain of the foregoing and related objects are also readily obtained in a kit for use in attaching a page to a wire binding of a wire bound notebook. The kit includes a first reinforcement strip and a second reinforcement strip. Each reinforcement strip includes a reinforcement layer, an adhesive layer and an outer covering release sheet. Each reinforcement strip is essentially the same as described above but differ in having the slit in one reinforcement strip angled in a direction opposite from that in the other reinforcement strip.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

In the drawings, wherein similar reference characters denote similar elements throughout the several views:

FIG. 1 is a partial perspective view of a reinforcement strip embodying the present invention;

FIG. 2 is a partial cross-sectional view of the reinforcement strip taken along line 2—2 shown in FIG. 1, showing a reinforcement layer and an adhesive layer;

FIG 3 is a partial perspective view of a wire bound notebook illustrating attachment of the reinforcement strip shown in FIG. 1, to repair a cover torn from a wire binding of the wire bound notebook;

FIGS 4 is a partial perspective view of a wire bound notebook shown in FIG. 3, illustrating the reinforcement strip shown in FIG. 1 in which the reinforcement strip is firmly secured to retain a cover that was initially torn from the wire binding of the wire bound notebook;

DETAILED DESCRIPTION OF THE PREFERRED EMBODIMENTS

Reinforcement Strip

Figure 7:
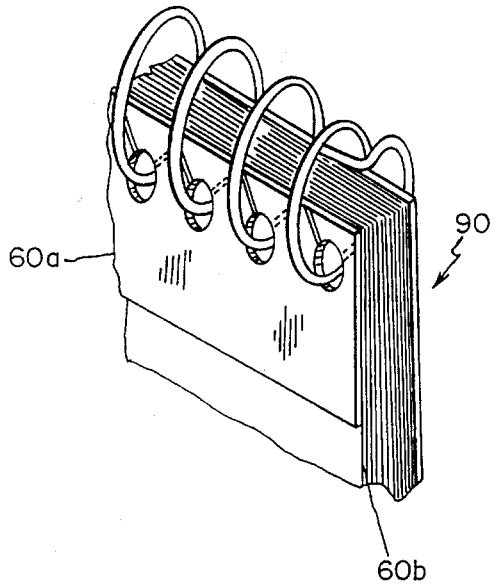
FIG 7 is a partial perspective view of a wire bound notebook illustrating the two reinforcement strips shown in FIG. 5 (less its outer covering release sheet) in which each reinforcement strip is firmly secured to opposite sides of a cover torn from its wire binding to retain it to a wire binding in a wire bound notebook.

Turning now in detail to the drawings, and in particular to FIG. 1, therein illustrated is a reinforcement strip 10 embodying the present invention for use in attaching a page to a wire binding of a wire bound notebook (not shown). Generally, reinforcement strip 10 includes a generally rectangularly-shaped reinforcement layer 20 and an adhesive layer 30.

Referring now to FIGS. 1 and 2, reinforcement layer 20 includes a first main surface 22, a second main surface 24 and a plurality of apertures 26 extending through first surface 22 to second surface 24. Preferably, reinforcement layer 20 is formed from reinforced paper or a plastic material. Reinforcement layer 20 is ideally and suitably fabricated from a thinly sized sheet of reinforced paper or plastic material and is shown in FIGS. 1 and 2, thicker than that required solely for illustration purposes.

Apertures 26 are positioned in generally a linear row parallel and adjacent to edge 25 of reinforcement layer 20. Apertures 26 are typically sized and disposed for registration with the perforated holes in pages of a typical wire bound notebook (not shown). Preferably, apertures 26 are generally circularly-shaped.

Reinforcement layer 20 further includes a plurality of slits 28 extending through first surface 22 to second surface 24 with each of slits 28 further extending from edge 25 of reinforcement layer 20 to edge 27 of aperture 26 to form a passage for allowing a turn of a wire binding of a wire bound notebook (not shown) to pass from edge 25 of reinforcement layer 20 to aperture 26. Each slit 28 is generally angled to one side of lines 29 located adjacent each aperture 26 on first surface 22 of reinforcement layer 20 and perpendicular to the linear row of apertures 26. Although, slit 28 can be a simple cut or slice through reinforcement layer 20, preferably slit 28 is sized to a predetermined width that is slightly larger than the diameter of a plastic or wire binding of a wire bound notebook (not shown).

Adhesive layer 30 is disposed in covering relationship to first surface 22 of reinforcement layer 20. Preferably, adhesive layer 30 is a layer of moisture activated adhesive. It is appreciated that reinforcement strip 10 can include an adhesive layer and an outer covering release sheet that can be removed by a user before attaching the reinforcement layer to a page to be repaired or attached to a wire binding of a wire bound notebook. Adhesive layer 30 is ideally and suitably a thinly applied layer of adhesive and is shown in FIGS. 1 and 2, thicker than that required solely for illustration purposes.

Referring now to FIG. 3, which illustrates the attachment of reinforcement strip 10 to a wire winding for repair of a cover page 42 initially torn from wire binding 41 of a wire bound notebook 40. Each hole 46 in the cover page 42 has a tear 48. Repair of cover page 42 is typically accomplished by first moistening adhesive layer 30 or removing the release strip therefrom (not shown in FIG. 3) and positioning reinforcement strip 10 adjacent wire binding 41, as shown in FIG. 3, such that each slit 28 is positioned directly in line with each turn of wire binding wire 41. Reinforcement strip 10 is slid, in the direction of arrows shown in FIG. 3, so that each turn of spiral wire passes through each adjacent slit 28 allowing each turn of wire to enter aperture 26. Contacting reinforcement strip 10 to the upper surface of cover 42 adheres reinforcement strip 10 in place and retains wire binding 41 in aperture 26, as shown in FIG. 4. Specifically, as shown in FIG. 4, slit 28 lines up with that portion of cover page 42 that is typically not torn and reinforcement strip 20 completely covers the tears 48 of cover page 42.

Kit

Figure 5:
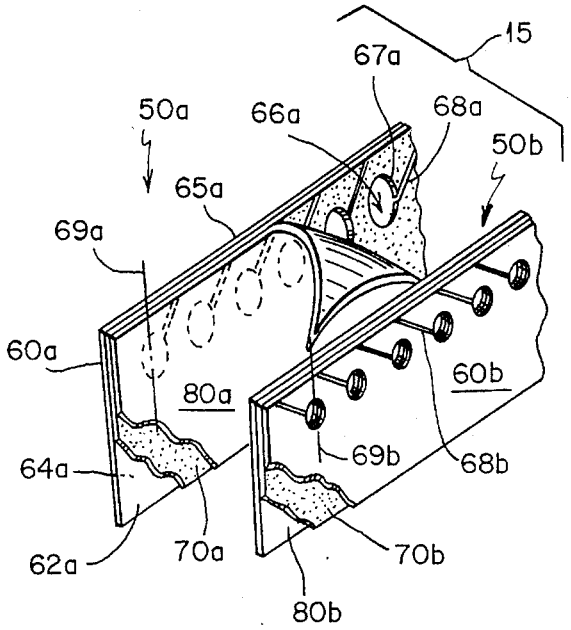
FIG. 5 is a partial perspective view of a kit for use in attaching a page to the wire binding in a wire bound notebook.

FIG. 5, illustrates a kit 15 for use in attaching a page to a wire binding of a wire bound notebook (not shown). Generally, kit 15 includes two generally rectangularly-shaped reinforcement strips 50*a* and 50*b*, each having a reinforcement layer 60*a* and 60*b*, an adhesive layer 70*a* and 70*b*, and an outer covering release sheet 80*a* and 80*b*, respectively. Reinforcement strips 50*a* and 50*b* are essentially the same and reference below is made solely to reinforcement strip 50*a* and applies to both. Those aspects that differ between reinforcement strips 50*a* and 50*b* are specifically pointed out below.

Referring still to FIG. 5, reinforcement layer 60*a* includes a first main surface 62*a*, a second main surface 64*a* and a plurality of apertures 66*a* extending through first surface 62*a* to second surface 64*a*. Preferably, reinforcement layer 60 is formed from a reinforced paper or a plastic material. Reinforcement layer 60*a* is ideally and suitably fabricated from a thinly sized sheet of reinforced paper or plastic material and is shown in FIG. 5, thicker than that required solely for illustration purposes.

Apertures 66*a* are positioned in generally a linear row parallel and adjacent to edge 65*a* of reinforcement layer 60*a*. Apertures 66*a* are typically sized and disposed for registration with the perforated holes in pages of a typical wire bound notebook (not shown). Preferably, apertures 66*a* are generally circularly-shaped.

Reinforcement layer 60*a*, further includes a plurality of slits 68*a* extending through first surface 62*a* to second surface 64*a* with each of slits 68*a* further extending from edge 65*a* of reinforcement layer 60*a* to edge 67*a* of aperture 66*a* to form a passage for allowing a turn of a wire binding of a wire bound notebook (not shown) to pass from edge 65*a* of reinforcement layer 60*a* to aperture 66*a*. Each slit 68*a* is generally angled to one side of lines 69*a* located adjacent each aperture 66*a* on first surface 62*a* of reinforcement layer 60*a* and perpendicular to the linear row of apertures 66*a*. Although, slit 68*a* can be a simple cut or slice through reinforcement layer 60*a*, preferably slit 68*a* is sized to a predetermined width that is slightly larger the diameter of a plastic or wire binding of a wire bound notebook (not shown).

As shown in FIG. 5, slits 68*a* and 68*b* are angled to opposite sides of lines 69*a* and 69*b* located adjacent each aperture 66*a* and 66*b* on first surface 62*a* and 62*b* of reinforcement layer 60*a* and 60*b* and perpendicular to the linear row of apertures 66*a* and 66*b*, respectively, so that when first side, 62*a* and 62*b* of reinforcement strip 60*a* and 60*b*, respectively, face each other and apertures 66*a* and 66*b* are aligned, slits 68*a* and 68*b* either cross or angle toward each other.

Adhesive layer 70*a* is disposed in covering relationship to first surface 62*a* of reinforcement layer 60*a*. Outer covering release sheet 80*a* is disposed in covering relationship to adhesive layer 70*a*. Adhesive layer 30 is ideally and suitably a thinly applied layer of adhesive and is shown in FIG. 5, thicker than that required solely for illustration purposes.

Figure 6:
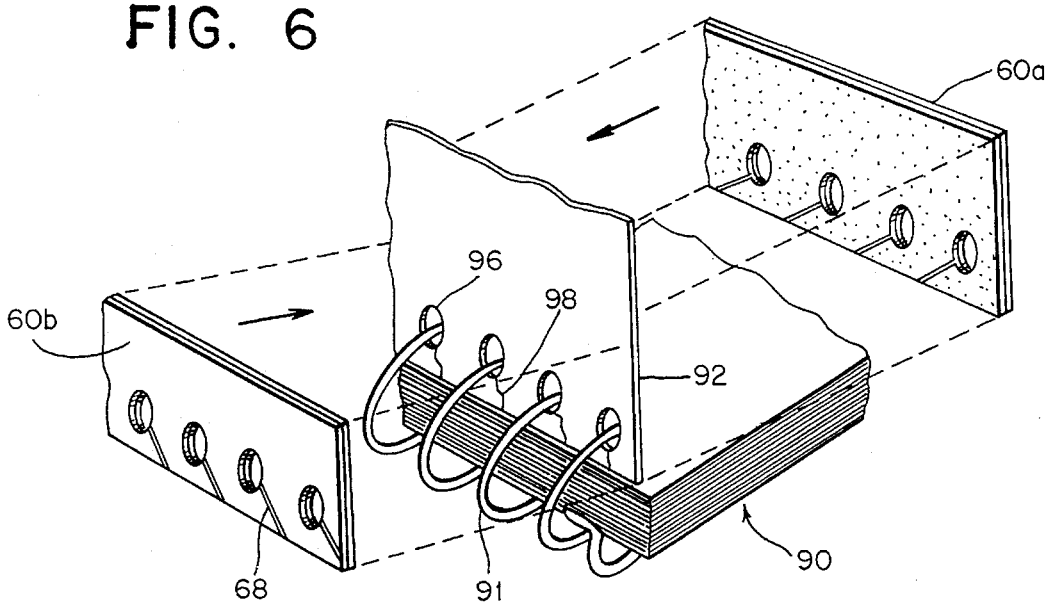
FIG. 6 is a partial perspective view of a wire bound notebook illustrating attachment of two reinforcement strips shown in FIG. 5 (less its outer covering release sheet), to repair a cover torn from a wire binding of a wire bound notebook, each of the reinforcement strip having slits in opposite directions for receiving the wire binding.

Referring now to FIG. 6, which illustrates the use of kit 15 for repair of a cover page 92 initially torn for wire binding 91 of wire bound notebook 90. Each perforated hole 96 in the cover page 92 has a tear 98. Repair of cover page 92 is typically accomplished by first removing outer covering release sheet 80*a* and 80*b* from reinforcement strips 50*a* and 50*b* (not shown in FIG. 5) and positioning reinforcement layer 60*a* and 60*b* adjacent opposite sides of cover page 92 and adjacent wire binding 91 such that each slit 68*a* and 68*b* are positioned directly in line with each turn of wire binding 91. Reinforcement layer 60*a* and 60*b* are slid, in the direction of arrows shown in FIG. 5, so that each turn of wire binding 91 passes through each slit 68*a* and 68*b* to allow each turn of wire to enter aperture 68*a* and 68*b*. Contacting each reinforcement layer 60*a* and 60*b* to opposite surfaces of cover 92 adheres reinforcement layer 60*a* and 60*b* to cover page 90 and retains the wire binding in apertures 66*a* and 66*b*.

Specifically, as shown in FIG. 7, slit 68*a* and 68*b* line up with that portion of cover page 92 that is typically not torn and reinforcement layer 60*a* and 60*b* completely cover tears 98 in cover page 92. In addition, slits 68*a* and 68*b* of reinforcement layers 60*a* and 60*b* either cross each other or angle toward each other. It is appreciated the kit 15 will work equally will in attaching a page to a wire binding in a notebook in which the page does not contain perforated holes. In this case, the page is simply located and attached to reinforcement layers 60*a* and 60*b* above apertures 68*a* and 68*b*.

It will be appreciated that a wide variety in the number of apertures and linear length of reinforcement strip can be configured for attaching a page to a wire binding of a wire bound notebook. In addition, reinforcement strip can be sized for the entire length of a page, or alternatively, configured as two separate portions which attach to the top and bottom portions of a page to be attached to a wire binding of a wire bound notebook.

Thus, while only several embodiments of the present invention have been shown and described, it is obvious that many changes and modification may be made thereunto without departing from the spirit and scope of the invention.

What is claimed is:

1. A reinforcement strip for use in attaching a page to a wire binding of a wire bound notebook, the reinforcement strip comprising:

a reinforcement layer having a first surface, a second surface, and a plurality of apertures extending through said first surface to said second surface, said plurality of apertures positioned in generally a linear row adjacent a first edge of said reinforcement layer, said reinforcement layer having a plurality of slits extending through said first surface to said second surface, each of said slits extending from said first edge of said reinforcement layer to a second edge defining said aperture to form a passage for allowing a turn of a wire binding of a wire bound notebook to pass from said first edge of said reinforcement layer to said aperture, each of said slits being disposed at a non-perpendicular angle to said first edge of said reinforcement layer; and means for attaching said first surface of said reinforcement layer to a page.

2. The reinforcement strip according to claim 1, wherein said reinforcement layer is generally rectangularly-shaped.

3. The reinforcement strip according to claim 2, wherein said plurality of apertures are generally circularly-shaped.

4. The reinforcement strip according to claim 3, wherein said slits are sized to a predetermined width that is slightly larger than a diameter of a wire binding of a wire bound notebook.

5. The reinforcement strip according to claim 1, wherein said reinforcement layer is fabricated from paper.

6. The reinforcement strip according to claim 1, wherein said reinforcement layer is fabricated from plastic.

7. The reinforcement strip according to claim 1, wherein said attaching means includes a layer of moisture activated adhesive.

8. The reinforcement strip according to claim 1, wherein said attaching means includes an adhesive layer in covering relationship to said first surface of said reinforcement layer and an outer covering release sheet disposed in covering relationship on said adhesive layer.

9. A kit for attaching a page to a wire binding of a wire bound notebook, comprising:

a first reinforcement strip having a) a first reinforcement layer having a first surface, a second surface, and a plurality of apertures extending through said first surface to said second surface, said plurality of apertures positioned in a linear row adjacent a first edge of said first reinforcement layer, said reinforcement layer having a plurality of slits extending through said first surface to said second surface, each of said slits extending from said first edge of said first reinforcement layer to a second edge defining one of said apertures to form a passage for allowing a turn of a wire binding of a wire bound notebook to pass from said first edge of said first reinforcement layer to said aperture, each of said slits being disposed at a non-perpendicular angle to said first edge of reinforcement layer;

b) first means for attaching said first surface of said first reinforcement layer to a first side of a page;

a second reinforcement strip having a) a second reinforcement layer having a first surface, a second surface, and a plurality of apertures extending through said first surface to said second surface, said plurality of apertures positioned in a linear row adjacent a first edge of said second reinforcement layer, said second reinforcement layer having a plurality of slits extending through said first surface to said second surface, each of said slits extending from said first edge of said second reinforcement layer to one of said apertures to form a passage for allowing a turn of a wire binding of a wire bound notebook to pass from said first edge of said second reinforcement layer to one of said apertures, each of said slits of said second reinforcement layer being generally oppositely angled relative to said slits of said first reinforcement layer; and b) second means for attaching said first surface of said second reinforcement layer to an opposite side of a page.

10. The kit according to claim 9, wherein said first and second reinforcement layers are generally rectangularly-shaped.

11. The kit according to claim 10, wherein said plurality of apertures in said first and second reinforcement layers are generally circularly-shaped.

12. The kit according to claim 11, wherein said slits in said first and second reinforcement layers are sized to a predetermined width that is slightly larger than a diameter of a wire binding of a wire bound notebook.

13. The kit according to claim 9, wherein said first and second reinforcement layers are fabricated from paper.

14. The kit according to claim 9, wherein said first and second reinforcement layers are fabricated from plastic.

15. The kit according to claim 9, wherein said first and second attaching means include a layer of moisture activated adhesive.

16. The kit according to claim 9, wherein said first and second attaching means include an adhesive layer in covering relationship to said first surface of said first and second reinforcement layers and an outer covering release layer disposed in covering relationship on each of said adhesive layers.

* * * * *